US005722491A

United States Patent [19]

Sullaway et al.

[11] Patent Number: 5,722,491

[45] Date of Patent: Mar. 3, 1998

[54] WELL CEMENTING PLUG ASSEMBLIES AND METHODS

[75] Inventors: Bobby L. Sullaway; David F. Laurel, both of Duncan, Okla.

[73] Assignee: Halliburton Company, Duncan, Okla.

[21] Appl. No.: 731,335

[22] Filed: Oct. 11, 1996

[51] Int. Cl.[6] ..... E21B 33/16

[52] U.S. Cl. ..... 166/291; 166/153; 166/155

[58] Field of Search ..... 166/153, 155, 166/156, 177.3, 285, 291, 376; 15/104.061

[56] References Cited

U.S. PATENT DOCUMENTS

| | | | |
|---|---|---|---|
| 2,223,442 | 12/1940 | Crowell | 166/291 X |
| 3,796,260 | 3/1974 | Bradley | 166/153 |
| 4,624,312 | 11/1986 | McMullin | 166/155 |
| 4,671,358 | 6/1987 | Lindsey, Jr. et al. | 166/291 |
| 4,809,776 | 3/1989 | Bradley | 166/153 |
| 5,020,597 | 6/1991 | Braddick et al. | 166/291 |
| 5,095,988 | 3/1992 | Bode | 166/291 |
| 5,191,932 | 3/1993 | Seefried et al. | 166/291 |
| 5,392,852 | 2/1995 | Laurel et al. | 166/153 |
| 5,413,172 | 5/1995 | Laurel | 166/153 |
| 5,522,458 | 6/1996 | Watson | 166/156 X |

*Primary Examiner*—George A. Suchfield

*Attorney, Agent, or Firm*—Craig W. Roddy; C. Clark Dougherty, Jr.

[57] ABSTRACT

An improved well cementing plug assembly adapted to be connected to a string of drill pipe or a circulation tool for use in a pipe during the cementing of the pipe in a well bore is provided. The top and bottom plugs are selectively releasable by activating balls dropped into the plug assembly. Different sizes of plugs can be used utilizing the same inner tubes and other assembly parts, and the top plug slides on its inner tube when a pressure differential is exerted on it thereby insuring a seal between the top and bottom plugs when the plugs are landed on a float shoe or the like.

21 Claims, 8 Drawing Sheets

44
44
10
46
59
46
52
42
42
56
174
20
134
24
12
86
14
176
160
170

WELL CEMENTING PLUG ASSEMBLIES AND METHODS

BACKGROUND OF THE INVENTION

1. Field of the Invention

This invention relates to well cementing plug assemblies for use in a pipe such as casing during the cementing of the pipe in a well bore.

2. Description of the Prior Art

In cementing pipe in a well, known in the art as primary cementing, a cement slurry is pumped downwardly through the pipe to be cemented and then upwardly into the annulus between the pipe and the walls of the well bore. Upon setting, the cement bonds the pipe to the walls of the well bore and restricts fluid movement between formations penetrated by the well bore.

Prior to the primary cementing operation, the pipe to be cemented is suspended in the well bore and both the pipe and well bore are usually filled with drilling fluid. In order to reduce contamination of the cement slurry at the inner face between it and the drilling fluid, a cementing plug for sealingly engaging the inner surface of the pipe is pumped ahead of the cement slurry whereby the cement slurry is separated from the drilling fluid as the cement slurry and drilling fluid are displaced through the pipe. The cementing plug wipes the drilling fluid from the walls of the pipe ahead of the cement slurry and maintains a separation between the cement slurry and drilling fluid until the plug lands on a float collar or float shoe attached to the bottom end of the pipe.

The cementing plug which precedes the cement slurry and separates it from drilling fluid is referred to herein as the "bottom plug." When the predetermined required quantity of the cement slurry has been pumped into the pipe, a second cementing plug, referred to herein as the "top plug", is released into the pipe to separate the cement slurry from additional drilling fluid or other fluid used to displace the cement slurry down the pipe.

When the bottom plug lands on the float collar or float shoe attached to the bottom of the pipe, a valve mechanism opens which allows the cement slurry to proceed through the plug, through the float collar or float shoe and upwardly into the annular space between the pipe and the well bore. The design of the top plug is such that when it lands on the bottom plug it shuts off fluid flow through the plugs which prevents the displacement fluid from entering the annulus. After the top plug lands, the usual practice is to continue pumping the displacement fluid into the pipe whereby the pipe is pressured up and the pipe and associated equipment including the pump are pressure tested for leaks or other defects. If the pipe cannot be pressured up, it is often the result of the top plug landing on the bottom plug in a misaligned position whereby the displacement fluid leaks around the sides of the top plug and through the bottom plug. A valve in the float collar or float shoe prevents the reverse movement of the cement slurry through the pipe. Once the cement slurry has set, the top and bottom cementing plugs are usually drilled out of the pipe.

While the top and bottom cementing plugs can be released into the pipe to be cemented in a variety of ways, it is generally the practice in cementing onshore wells to suspend a plug assembly from a cement slurry and displacement fluid circulation tool sealingly disposed in the top end of the pipe to be cemented. In offshore wells, a similar cementing plug assembly is connected to a string of drill pipe which is lowered below the sea surface into the top of the pipe to be cemented. The cement slurry and displacement fluid are pumped through the drill string to the sub-surface release cementing plug assembly.

While the cementing plug assemblies utilized heretofore have generally been successful, different sizes of complete cementing plug assemblies have been required for use in different sizes of pipe to be cemented. In addition, as mentioned, problems have been encountered as a result of the misalignment of the top plug which prevents a fluid tight seal when the top plug lands on the bottom plug after the cement slurry has been displaced into the annulus. Thus, there is a need for improved cementing plug assemblies which are at least partially universal whereby different sizes of plugs can be readily substituted on the basic assembly. In addition, there is a need for improved cementing plug assemblies which insure that a fluid tight seal will result when the top plug lands on the bottom plug.

SUMMARY OF THE INVENTION

The present invention provides improved well cementing plug assemblies and methods of cementing pipe in wells using the assemblies which meet the needs described above and overcome the deficiencies of the prior art. The improved cementing plug assemblies of this invention are basically comprised of a bottom annular cementing plug having a longitudinal internal opening extending therethrough and having an inner tube attached within the internal opening. The bottom plug inner tube includes an interior activating ball annular seat at the lower end thereof and a lateral port disposed in the lower end portion of the inner tube above the activating ball annular seat. In addition, the lower end portion of the inner tube is of a shape which provides a flow space exiting the bottom plug between the interior of the bottom plug internal opening and the exterior of the lower end portion of the inner tube. A rupturable member which ruptures at a predetermined differential fluid pressure is sealingly disposed over the lateral opening in the bottom plug inner tube.

A top annular cementing plug having a longitudinal internal opening extending therethrough is also provided which includes an elongated inner tube snugly disposed through the internal opening whereby the top plug is free to slide on the inner tube when a differential fluid pressure is exerted thereon. The bottom end of the top plug inner tube is sealingly attached to the top end of the bottom plug inner tube by a first differential fluid pressure activated releasable connector, and the top end of the top plug inner tube is sealingly attached to a string of drill pipe or a circulation tool by a second differential fluid pressure activated releasable connector.

In a preferred assembly, both the first and second releasable connectors include activating ball annular seats formed therein or connected thereto whereby both releasable connectors are selectively closed by dropping activating balls therein and then activated to selectively release the top and bottom plugs by predetermined differential fluid pressures exerted thereon.

It is, therefore, a general object of the present invention to provide improved well cementing plug assemblies and methods.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

Figure 1A:
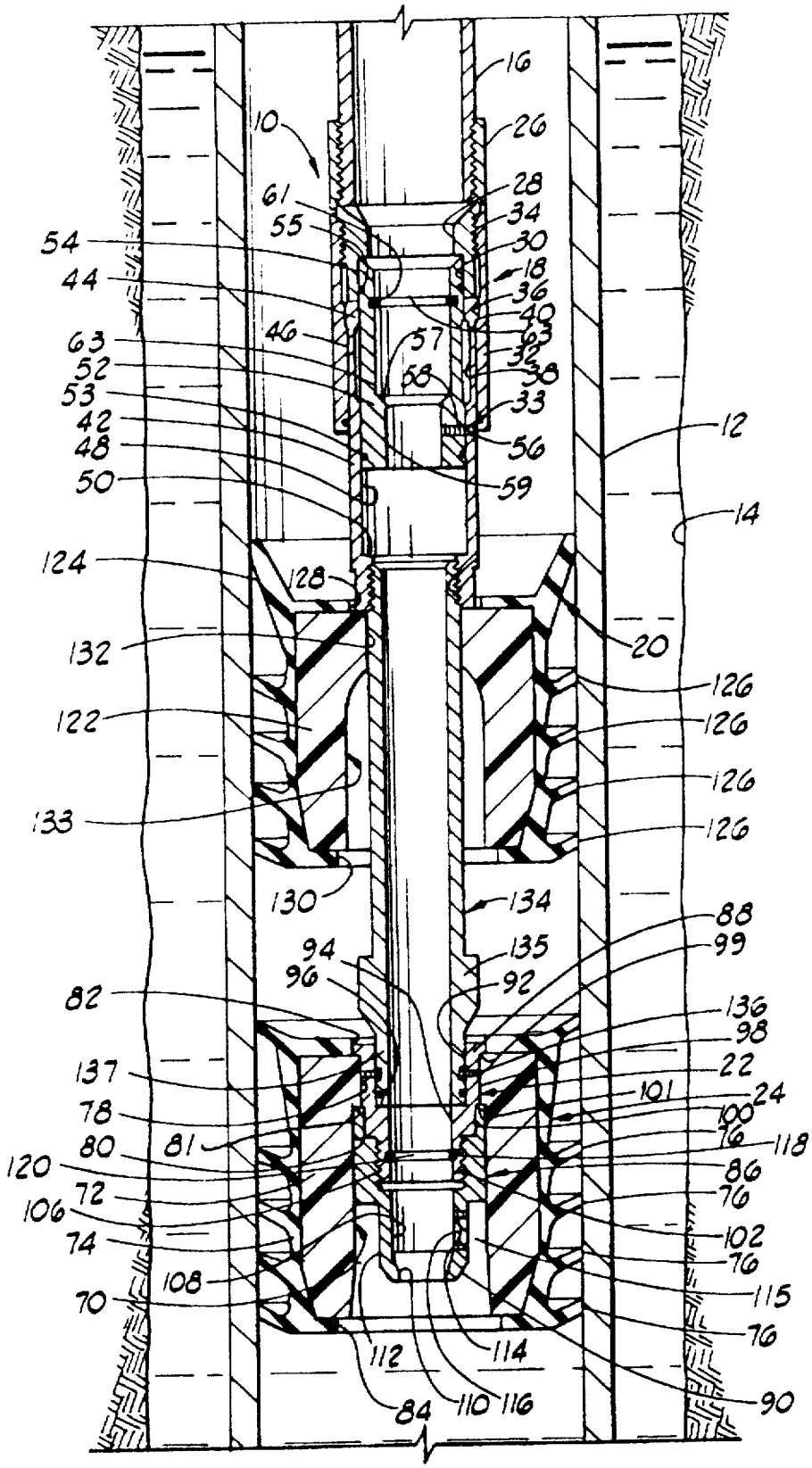
FIG. 1A is a side cross-sectional view of a well bore and a pipe to be cemented therein having a cementing plug assembly of the present invention installed in its initial position in the pipe.

Referring now to the drawings and particularly to FIG. 1A, a well cementing plug assembly of the present invention is illustrated and generally designated by the numeral 10. The plug assembly 10 is shown positioned within a pipe 12 which is to be cemented in a well bore 14. The plug assembly 10 is in its initial position in the pipe 12 whereby it is releasably connected to the lower end of a string of drill pipe or a conventional circulation tool 16.

The plug assembly 10 is basically comprised of a first differential fluid pressure activated releasable connecting assembly 18 which is connected to the drill string or circulation tool 16, a top cementing plug 20, a top plug inner tube 134 releasably connected to the assembly 18, a second differential fluid pressure activated releasable connecting assembly 22 connected to the top plug inner tube 134, a bottom cementing plug 24 and a bottom plug inner tube 86 releasably connected to the assembly 22.

As illustrated in FIG. 1A, the first fluid pressure activated releasing assembly 18 includes a coupling 26 which is threadedly connected to the lower end of the drill string or circulation tool 16. The coupling 26 includes a first internal bore 28 and a second larger internal bore 30, and is connected to a collet retainer 32 at an external threaded connection 34 thereon. The collet retainer 32 includes a first internal bore 36 and a second internal bore 38 with an annular beveled shoulder 40 in between.

The upper end of a collet 42 is disposed in the collet retainer 32 below the coupling 26 so that the head portions 44 of a plurality of collet fingers 46 engage and are retained by the annular shoulder 40 in the collet retainer 32. The collet 42 includes an internal bore 48 and has an upwardly facing shoulder 50 at the lower end of the bore 48.

A releasing sleeve 52 is slidably disposed in and has an outer surface 54 in close spaced relationship with the second bore 30 of the connector 26 and the bore 48 of the collet 42. The releasing sleeve 52 includes an internal activating ball annular seat 57 which connects to an internal bore 59 and an activating ball retaining O-ring 61 disposed in a groove 63 positioned above the activating ball annular seat 57. As will be understood by those skilled in the art, in the position illustrated in FIG. 1, the releasing sleeve 52 keeps the head portions 44 of the collet fingers 46 engaged with the annular shoulder 40 of the collet retainer 32.

At least one shear pin 56 is engaged with the collet 42 and extends into a recess 58 in the releasing sleeve 52 whereby the releasing sleeve 52 is held in the upper collet retaining position shown in FIG. 1.

An O-ring seal 33 is disposed in a groove positioned adjacent the lower end and in the interior of the collet 32 to provide a seal between the collet retainer 42 and the collet 32 whereby fluids outside the releasing assembly 18 do not leak into the interior thereof. Also, a pair of O-ring seals 53 and 55 are disposed in grooves positioned adjacent the ends and in the exterior of the releasing sleeve 52 to provide a seal around the collet heads 44 and fingers 46. The O-ring seals 33, 53 and 55 insure that the cement slurry or other fluid from inside or outside the releasing assembly 18 does not clog and interfere with the operation of the collet and releasing sleeve mechanism.

The bottom cementing plug 24 of the assembly 10 includes a longitudinal internal opening 70 extending therethrough. The bottom cementing plug 24 is comprised of a solid hollow insert 72, preferably formed of an easily drillable material such as a plastic material, having an elastomeric jacket 74 disposed around and attached to the insert 72. The elastomeric jacket 74 includes a plurality of annular wipers 76 thereon for sealingly engaging the inner surface of the pipe 12. As will be understood by those skilled in the art, the wipers 76 extend outwardly and angularly upwardly into contact with the inner surface of the pipe 12 and function to wipe fluid from the walls of the pipe 12 and prevent mixing of that fluid with the fluid following the plug.

The opening 70 extending through the plug 24 is comprised of an upper internal bore 78 in the solid insert 72 and a second larger lower internal bore 80 which forms a downwardly facing annular shoulder 81 in the insert 72. The elastomeric jacket 72 includes upper and lower openings 82 and 84 therein, respectively.

A bottom plug inner tube, generally designated by the numeral 86, is attached within the internal opening 70 of the bottom plug 24. The inner tube 86 is formed of two parts threadedly connected together, i.e., an upper part 88 and a lower part 90. The upper part 88 is an annular member including an upper internal bore 92 and a second smaller internal bore 94 which forms an internal upwardly facing annular shoulder 96. The external surface of the upper part 88 includes a first external recess 98 forming a downwardly facing annular shoulder 99, a second smaller recess 100 forming a downwardly facing annular shoulder 101 and a third even smaller threaded recess 102. The upper part 88 is positioned with the recess 98 thereof fitted within the bore 78 of the insert 72. The shoulder 99 of the part 88 abuts the top surface of the insert 72 and prevents the insert 72 from moving upwardly.

The lower part 90 is generally cylindrical in shape and is threadedly attached to the upper part 88 within the opening 70 of the cementing plug 24. That is, the lower part 90 includes an upper internal bore 104 within which the recess 100 of the upper part 88 is positioned. The upper annular surface of the lower part 90 abuts the annular shoulder 81 of the insert 72 preventing it from moving downwardly and locking it to the inner tube 86. The part 90 includes a second smaller threaded bore 106 below the bore 104 which is threadedly engaged with the threads 102 of the upper part 88. A third even smaller bore 108 extends below the bore 106 which terminates in a tapered inwardly extending activating ball annular seat 110. A lower end portion of the lower part 90 is defined by an external recess 112, and a lateral port 114 is formed in the lower end portion of the part 90. The recess 112 forms a flow space 115 exiting the bottom of the bottom plug 24 between the exterior of the lower end portion of the lower part 90 of the inner tube 86 and the bore 80 in the insert 72 which forms a part of the longitudinal interior opening 70 in the cement plug 24.

A rupturable member 116 which ruptures at a predetermined differential fluid pressure is sealingly disposed over the lateral port 114 in the lower part 90 of the bottom plug inner tube 86. As will be described further, the lateral port 114 and rupturable member 116 are positioned above the activating ball annular seat 110 so that when an activating ball is seated on the seat 110 and the rupturable member ruptures, fluid within the inner tube 86 exits by way of the lateral port 114 therein. An activating ball retaining O-ring 118 is disposed in a groove 120 formed in the upper part 88 of the bottom plug inner tube 86.

The top annular cementing plug 20 is similar to the bottom plug 24 and includes an annular solid insert 122 formed of plastic material or the like having an internal opening 132 therethrough and an elastomeric jacket 124 disposed around and attached to the insert 122. The elastomeric jacket includes a plurality of annular wipers 126 thereon for sealingly engaging the inner surface of the pipe 12. The elastomeric jacket 124 includes top and bottom openings 128 and 130, respectively, which in combination with the internal opening 132 in the annular insert 122 forms a longitudinal internal opening 133 extending through the top cementing plug 20.

An elongated top plug inner tube 134 is disposed through the internal opening 133 of the top plug 20. The top end of the inner tube 134 is threadedly connected to the lower end of the collet 42 of the releasable connecting assembly 18, and the top internal portion of the internal opening 132 in solid insert 122 fits snugly around the outside surface of the inner tube 134, but is not attached thereto. As a result, the top plug 20 is free to slide on the inner tube 134 when a differential fluid pressure is exerted on the top plug 20.

The bottom end of the inner tube 134 includes an enlarged portion 135 for preventing the top plug 20 from sliding off of the inner tube 134. The bottom end portion 137 of the inner tube 134 is of a size whereby it telescopingly fits within the upper bore 92 of the bottom plug inner tube 86. At least one shear pin 136 (two are shown) is engaged with the bottom plug inner tube 86 and extends into a recess in the top plug inner tube 134 whereby the bottom plug inner tube 86 is releasably connected to the top plug inner tube 134.

The assembly illustrated in FIG. 1A and described above is normally utilized in offshore subsea applications where it is important to utilize a top plug differential fluid pressure activated releasably connecting assembly which insures that the top plug does not inadvertently disconnect from the drill string when the bottom plug is released. Consequently, the assembly 10 includes a collet releasing mechanism which cannot be accidently released by the application of a downward force on the plug assembly 10, but instead requires the positive movement of the releasing sleeve 52 after an activating ball has been seated therein.

Figure 1B:
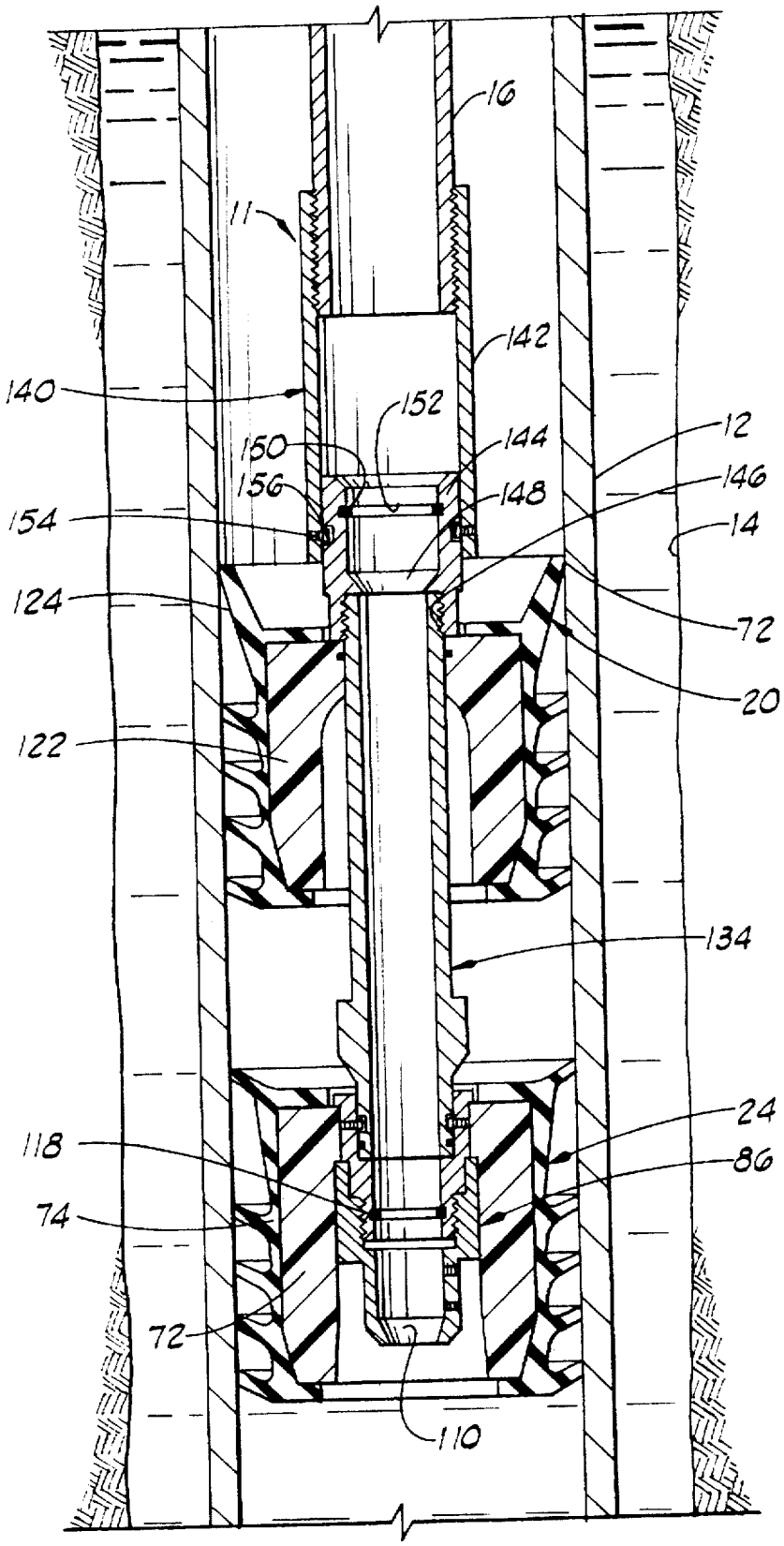
FIG. 1B is a view similar to FIG. 1A but showing an alternate arrangement of top plug releasing structure.

Referring now to FIG. 1B, an alternate cementing plug assembly 11 is illustrated. The cementing plug assembly 11 is identical to the cementing plug assembly 10 described above (and like numerals indicate like parts) except that the top plug releasable connecting mechanism of the cementing plug assembly 11 includes one or more shear pins or the equivalent thereto instead of a collet releasing mechanism.

The top plug releasable connecting assembly of the cementing plug assembly 11 is generally designated by the numeral 140, and includes a coupling 142 threadedly connected to the drill string or circulation tool 16. An annular connector 144 is connected at its upper end portion to the coupling 142 and at its lower end portion to the top plug inner tube 134 by means of a threaded connection 146. The upper end portion of the connector 144 is telescopingly fitted within the bottom interior portion of the coupling 142, and at least one shear pin 154 (two are shown) is engaged with the coupling 142 and extends into a recess 156 in the connector 144. The connector 144 includes an interior activating ball annular tapered seat 148 near the bottom thereof, and an activating ball retaining O-ring 150 is positioned in a groove 152 positioned above the annular seat 148.

While the cementing plug assembly 11 can be utilized in both onshore and offshore cementing operations, it is normally utilized in onshore operations where the accidental release of the top plug is not as serious a problem as is the case in offshore cementing operations.

Operation

Referring now to FIGS. 1–7, the operation of the well cementing plug assembly 10 will be described which is the same as the operation of the cementing plug assembly 11 except as noted below. As previously mentioned, both the pipe 12 to be cemented and the well bore 14 are usually filled with drilling fluid prior to commencing primary cementing operations.

Figure 2:
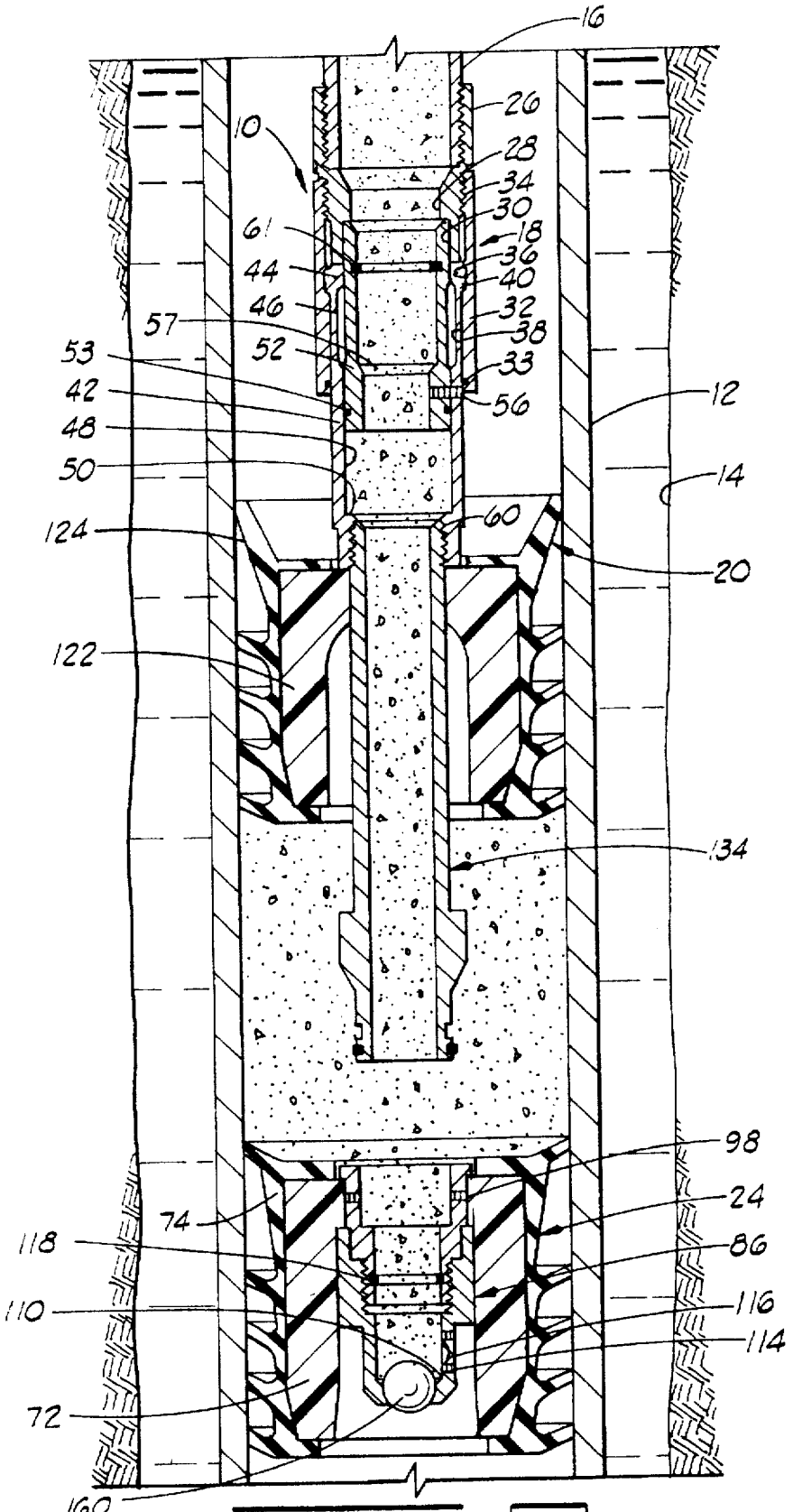
FIG. 2 is a cross-sectional view similar to FIG. 1 showing the cementing plug assembly after the release of the bottom plug.

After positioning the cementing plug assembly 10 within the well bore 14 and the pipe 12 disposed therein as shown in FIG. 1, an activating ball 160 is dropped into and caused to be moved in a known manner through the drill string or circulating tool 16, through the plug releasing assembly 18, through the inner tube 134 within the top plug 120 and into and through the inner tube 86 within the bottom plug 24 into engagement with the annular activating ball seat 110 therein as shown in FIG. 2. As will be understood, the activating ball annular seat 110 in the bottom plug inner tube 86 is of a smaller size than the annular seat 57 in the releasing sleeve 52 of the top plug releasing assembly 18, and the ball 160 is of a size such that it passes through the annular seat 57, but seats on the annular seat 110. Further, as will also be understood, the differential fluid pressure required to activate the bottom plug releasable connecting assembly 22 and release the bottom plug 24 is the predetermined differential fluid pressure exerted on the inner tube 86 of the bottom plug 24 which causes the shear pin or pins 136 to shear. A differential fluid pressure higher than that required to activate the bottom plug releasable connecting assembly 22 must be exerted on the top plug releasable connecting assembly 18 to cause the shear pin 56 to shear and the top plug to be released. A predetermined differential fluid pressure higher than the pressure required to activate the releasable connecting assembly 22, but lower than that required to activate the releasable connecting assembly 18, is required to rupture the rupturable member 116 in the bottom plug inner tube 86.

Once the activating ball 160 seats on the seat 110 of the bottom plug inner tube 86 whereby the inner tube 86 is closed, the differential fluid pressure exerted on the inner tube 86 is increased by pumping a cement slurry into the assembly 10 by way of the drill string or circulating tool 16 until the shear pin or pins 136 shear and the bottom plug 24 is released from the assembly 10 as is also illustrated in FIG. 2.

After the bottom plug 24 is released, the cement slurry is continuously pumped into the interior of the pipe 12 by way of the drill string or circulating tool 16, the top plug releasing assembly 18 and the inner tube 134 of the top plug 20 which displaces the bottom plug 24 and the drilling fluid ahead of the bottom plug 24 through the pipe 12.

Figure 3:
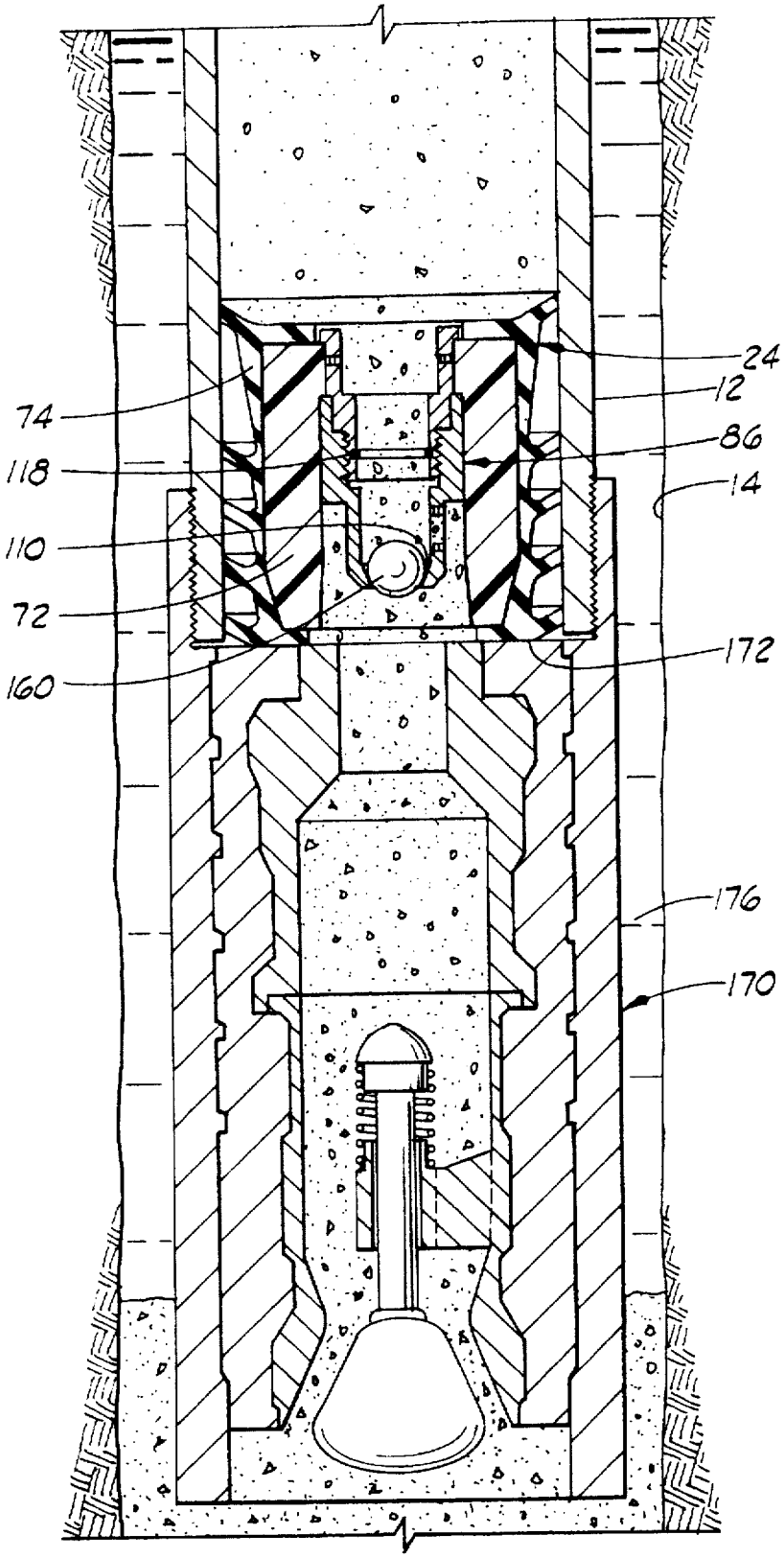
FIG. 3 is a cross-sectional view similar to FIG. 1 showing a float shoe attached at the bottom end of the pipe to be cemented after the bottom plug has landed thereon.

As shown in FIG. 3, when the bottom plug 24 reaches the float shoe 170 at the bottom of the pipe 12, the lower end of the bottom plug seats on a seating surface 172 on top of the float shoe. The ball 160 which has been retained in the inner tube 86 of the bottom plug 24 during its travel down the pipe 12 by the O-ring 118 remains seated on the annular seat 110 of the inner tube 86.

When the bottom plug 24 lands on the float shoe 170, the pumping of the cement slurry is continued until the predetermined volume of cement slurry required for cementing the pipe 12 in the well bore 14 has been pumped into the pipe 12. During that pumping, the differential pressure exerted in the inner tube 86 of the cementing plug 24 reaches the level whereby the rupturable member 116 disposed over the lateral port 114 of the inner tube 86 ruptures and the cement slurry flows through the bottom plug 24, through the float shoe 170 and into the annulus 176 between the pipe 12 and the walls of the well bore 14, all as shown in FIG. 3.

Figure 4:
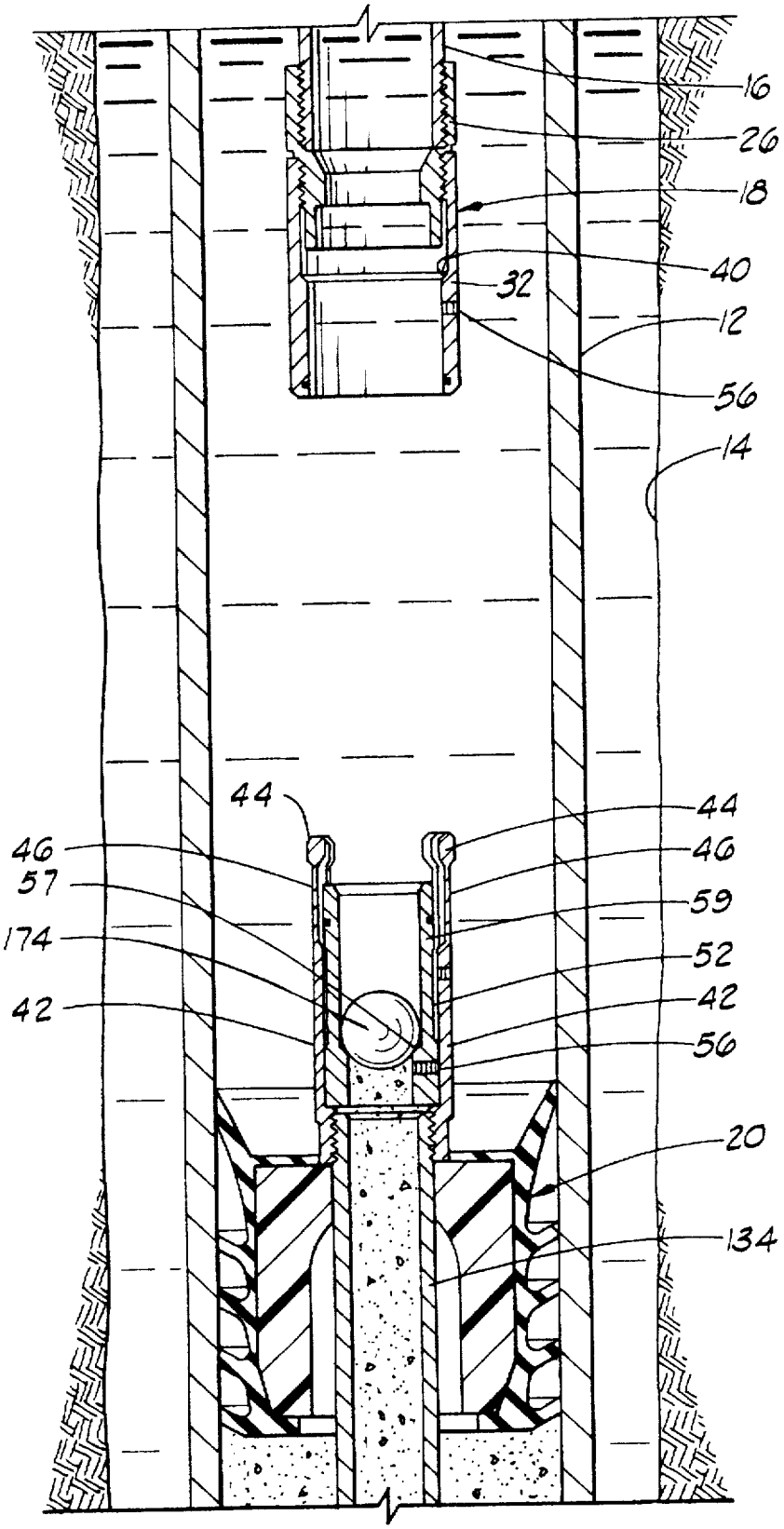
FIG. 4 is a view similar to FIG. 1 showing the cementing plug assembly after the release of the top plug.

Referring now to FIG. 4, when the predetermined volume of cement slurry has been pumped into the pipe 12, the top plug releasing mechanism 18 is activated whereby the top plug 20 is released. This is accomplished by dropping an additional larger activating ball 174 into the drill string or circulating tool 16 and causing it to move into contact with the internal activating ball annular seat 57 in the releasing sleeve 52 of the top plug releasable connecting assembly 18. When seated on the annular seat 57, the activating ball 174 closes the releasing sleeve 52. Thereafter, a displacement fluid is pumped into the closed releasing sleeve 52 by way of the drill string or circulating tool 16 whereby a differential fluid pressure sufficient to rupture the shear pin or pins 56 is reached. The rupture of the shear pin or pins 56 causes the releasing sleeve 52 to be moved from its upper collet finger retaining position illustrated in FIG. 2 to the lower collet finger releasing position illustrated in FIG. 4. When the releasing sleeve 52 is moved to its lower releasing position, the head portions 44 of the collet fingers 46 disengage from the annular shoulder 40 of the collet retainer 32 and the top plug 20 is released and moved downwardly as shown in FIG. 4.

Figure 5:
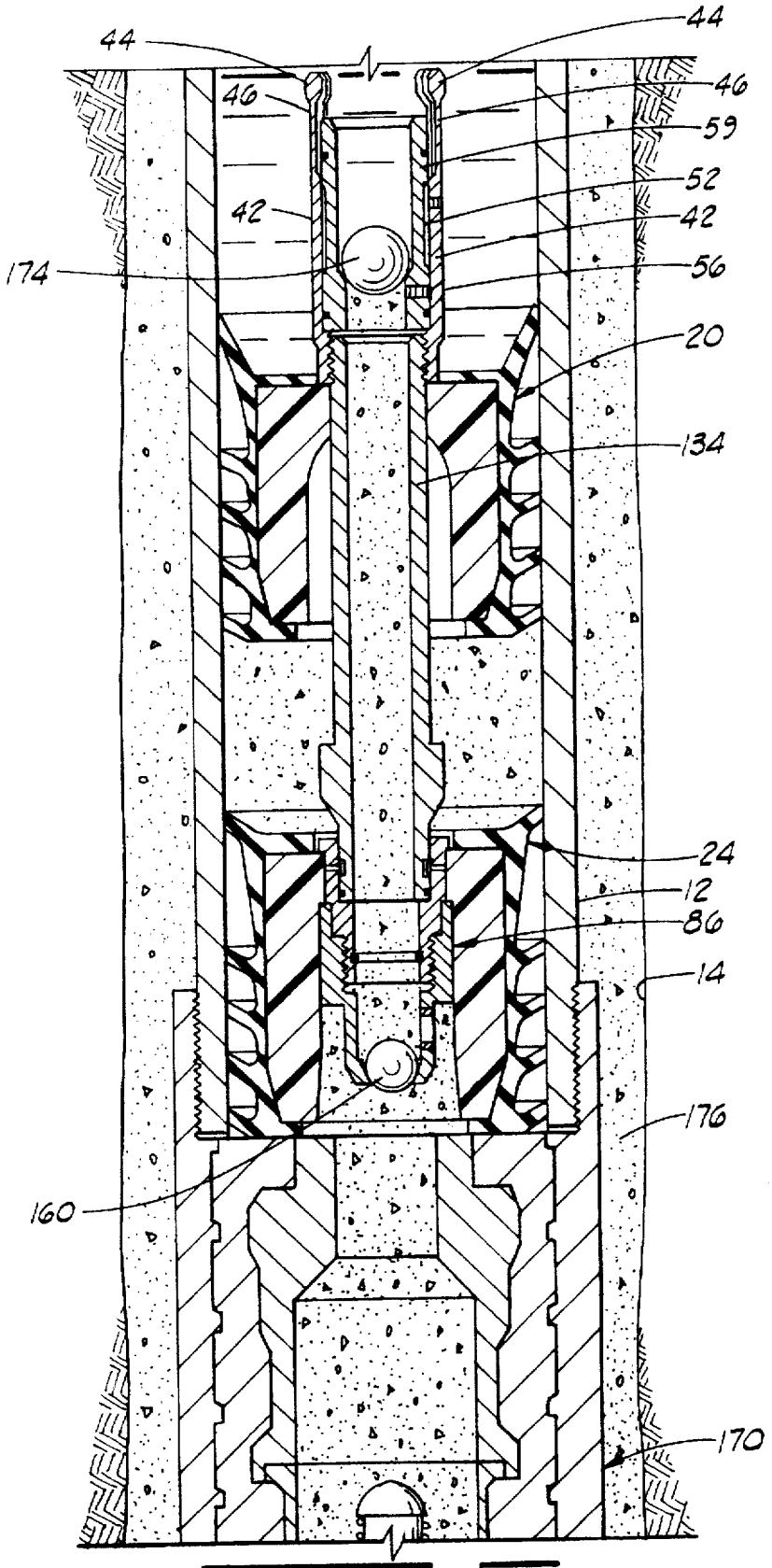
FIG. 5 is a view similar to FIG. 3 showing the float shoe after the top and bottom plugs have landed thereon.

The continued pumping of the displacement fluid behind the top plug 20 displaces the plug 20 and the cement slurry ahead of the plug 20 through the interior of the pipe 12 and into the annulus 176 between the pipe 12 and the walls of the well bore 14 as shown in FIG. 5. When the top plug 20 reaches the bottom of the pipe 12, it lands on the plug 24 as is also shown in FIG. 5. Upon landing, the bottom end of the top plug inner tube 134 engages the top portion of the bottom plug inner tube 86 thereby closing the cement slurry flow path through the bottom plug 24. As mentioned above, after the top plug 20 lands on the bottom plug 24, the pressure exerted on the cementing plugs is increased to insure that a fluid tight seal is provided by the cementing plug and to pressure test the pipe 12 and other associated equipment for leaks.

After the top plug 20 has been landed and the seal of the pipe 12 verified, the cement slurry in the annulus 176 is allowed to set whereby the pipe 12 is cemented in the well bore 14. If the well bore 14 is to be extended by additional drilling below the end of the pipe 12, or if it is otherwise desirable to remove the plugs and other components of the assembly 10 from the pipe 12 as well as the internals of the float shoe 110, the plugs, components and float shoe internals are drilled out of the pipe 12 and out of the float shoe 110 utilizing conventional drilling techniques.

The operation of the cementing plug assembly 11 illustrated in FIG. 1B is identical to that described above for the assembly 10 except that the activating ball 174 is caused to seat on the internal activating ball annular tapered seat 148 in the connector 144 whereby the connector 144 is closed. The pumping of the cement slurry into the coupling 142 and connector 114 provide a differential fluid pressure on the shear pin or pins 154 causing the shear pin or pins to shear and the top plug 20 to be released.

Figure 6:
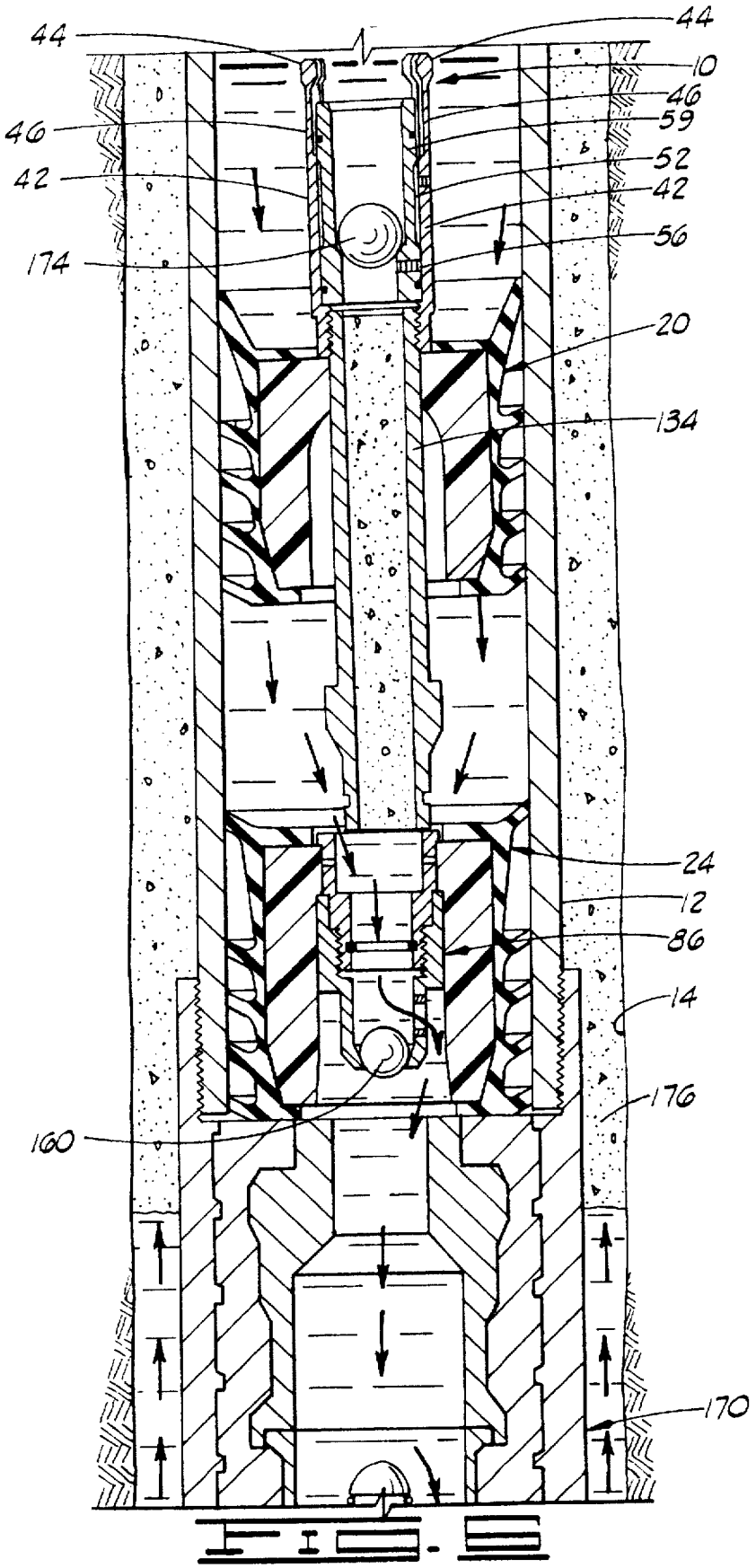
FIG. 6 is a view similar to FIG. 5, but showing the top plug after it has improperly landed on the bottom plug as a result of being misaligned with the bottom plug.

Referring now to FIG. 6, the cementing plug assembly 10 is illustrated after the bottom and top plugs 24 and 20, respectively, have landed on the float shoe 170 except that the top plug inner tube 134 has failed to properly seat within the bottom plug inner tube 86. That is, the top plug 20 and its inner tube 134 have landed on the bottom plug 24 in a misaligned position. Consequently, the pipe 12 is not sealed and displacement fluid leaks around the top plug 20 and through the inner tube 86 of the bottom plug 24 into the float shoe 170 and the annulus 176 as shown by the arrows on FIG. 6.

Figure 7:
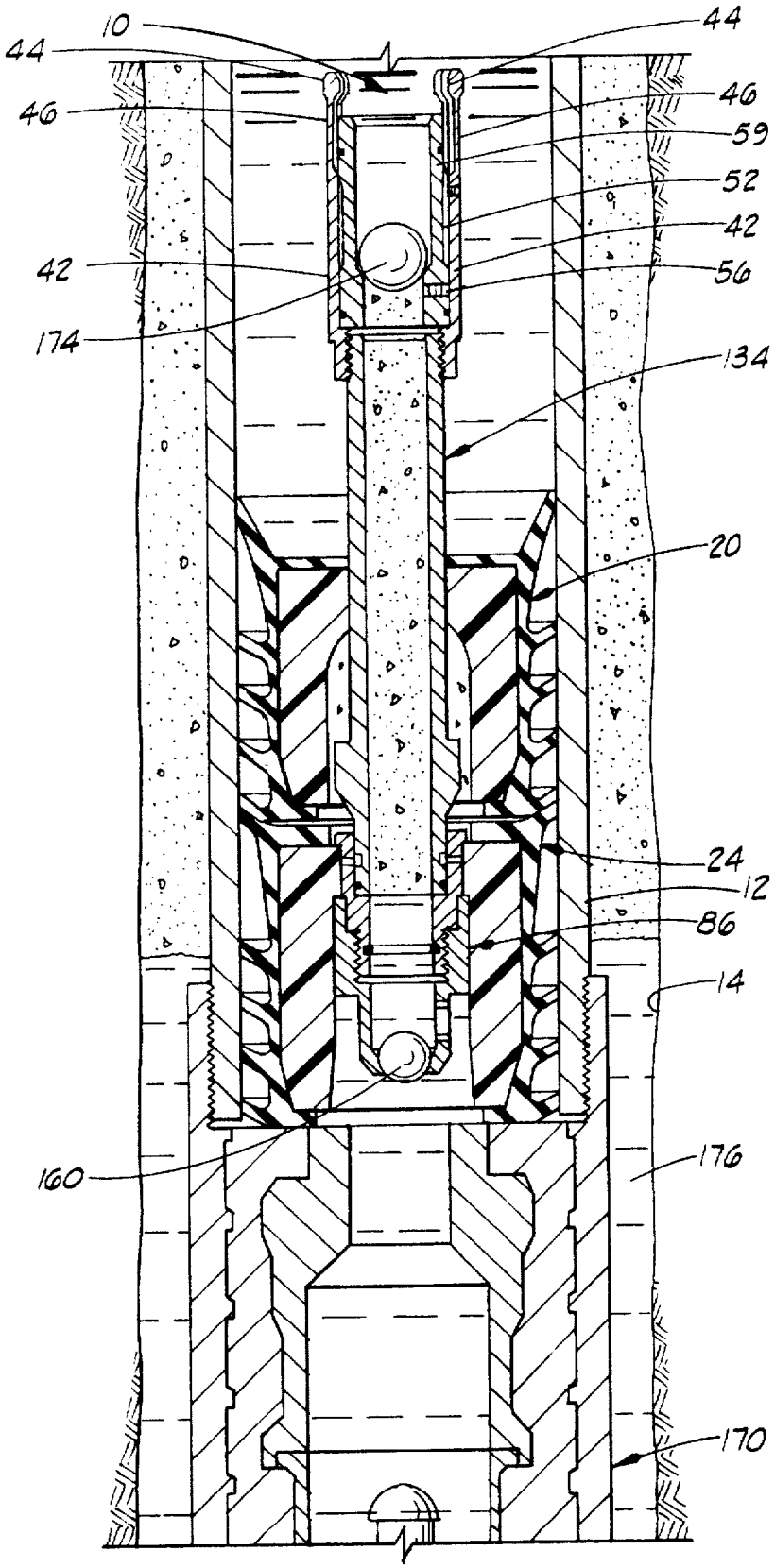
FIG. 7 is a view similar to FIG. 6, but showing the top plug after it has been moved downwardly on its inner tube and the misalignment of the top plug thereby corrected.

In order to correct the misalignment and seal failure of the top cementing plug 20 and inner tube 134, the continued pumping of the displacement fluid after the top plug 20 lands on the bottom plug 24 causes a differential pressure to be exerted on the top plug 20. As shown in FIG. 7, the differential pressure in turn causes the top plug 20 to slide on the inner tube 134 downwardly into contact with the bottom plug 24. This downward movement of the top plug 20 causes the inner tube 134 to be moved into alignment with the bottom plug inner tube 86 and to sealingly engage the bottom plug inner tube 86. Further, the seating of the top plug 20 on the bottom plug 24 creates a seal between the plugs, all of which stops the flow of displacement fluid and causes a tell tale pressure increase at the surface.

Thus, the present invention is well adapted to carry out the objects and attain the benefits and advantages mentioned as well as those which are inherent therein. While numerous changes to the apparatus and methods can be made by those skilled in the art, such changes are encompassed within the spirit of this invention as defined by the appended claims.

What is claimed is:

1. A well cementing plug assembly adapted to be connected to a string of drill pipe or a circulation tool for use in a pipe during the cementing of the pipe in a well bore, the pipe including a float shoe or the like on which the plug assembly lands, comprising:

a bottom annular cementing plug having a longitudinal internal opening extending therethrough;

a bottom plug inner tube attached within said bottom plug internal opening, said inner tube including an interior activating ball annular seat at the lower end thereof, a lateral port disposed in the lower end portion of said inner tube above said activating ball annular seat, and said lower end portion of said inner tube being of a shape which provides a flow space exiting said bottom plug between the interior of said bottom plug internal opening and the exterior of said lower end portion of said inner tube;

a rupturable member which ruptures at a predetermined differential fluid pressure sealingly disposed over said lateral port in said bottom plug inner tube;

a top annular cementing plug having a longitudinal internal opening extending therethrough;

an elongated top plug inner tube snugly disposed through said top plug internal opening whereby said top plug is free to slide on said inner tube when a differential fluid pressure is exerted thereon;

the bottom end of said top plug inner tube being sealingly attached to the top end of said bottom plug inner tube by a first differential fluid pressure activated releasable connecting means; and the top end of said top plug inner tube being sealingly attached to said string of drill pipe or said circulation tool by a second differential fluid pressure activated releasable connecting means.

2. The assembly of claim 1 wherein said first differential fluid pressure activated releasable connecting means comprises:

said bottom end of said top plug inner tube and said top end of said bottom plug inner tube being sealingly fitted together; and shearable means connected between said inner tubes for retaining said inner tubes sealingly fitted together until a predetermined differential fluid pressure is exerted on said bottom plug inner tube which causes said shearable means to shear and said inner tubes to separate.

3. The assembly of claim 2 wherein said shearable means comprises one or more shear pins.

4. The assembly of claim 1 wherein said second differential fluid pressure activated releasable connecting means comprises:

a coupling sealingly connected to said string of drill pipe or said circulation tool;

said top end of said top plug inner tube and the bottom end of said coupling being sealingly fitted together; and shearable means connected between said inner tube and said coupling for retaining said inner tube and coupling sealingly fitted together until a predetermined differential fluid pressure is exerted on said inner tube which causes said shearable means to shear and said inner tube and coupling to separate.

5. The assembly of claim 4 wherein said shearable means comprises one or more shear pins.

6. The assembly of claim 4 wherein said second releasable connecting means further comprises an interior activating ball annular seat connected to said top plug inner tube.

7. The assembly of claim 6 wherein said activating ball annular seat connected to said top plug inner tube is larger than said activating ball annular seat disposed in said bottom plug inner tube whereby an activating ball adapted to seat on said annular seat disposed in said bottom plug inner tube passes through said annular seat connected to said top plug inner tube.

8. The assembly of claim 1 wherein said top and bottom annular cementing plugs each comprise:

a solid hollow insert; and an elastomeric jacket disposed around said insert, said jacket having a plurality of wipers thereon for sealingly engaging an inner surface of said pipe.

9. A well cementing plug assembly adapted to be connected to a string of drill pipe or a circulation tool for use in a pipe during the cementing of the pipe in a well bore, the pipe including a float shoe or the like on which the plug assembly lands, comprising:

a bottom annular cementing plug having a longitudinal internal opening extending therethrough;

a bottom plug inner tube attached within said bottom plug internal opening, said inner tube including an interior activating ball annular seat at the lower end thereof, a lateral port disposed in the lower end portion of said inner tube above said activating ball annular seat, and said lower end portion of said inner tube being of a shape which provides a flow space exiting said bottom plug between the interior of said bottom plug internal opening and the exterior of said lower end portion of said inner tube;

a rupturable member which ruptures at a predetermined differential fluid pressure sealingly disposed over said lateral port in said bottom plug inner tube;

a top annular cementing plug having a longitudinal internal opening extending therethrough;

an elongated top plug inner tube snugly disposed through said top plug internal opening whereby said top plug is free to slide on said inner tube when a differential fluid pressure is exerted thereon;

said bottom end of said top plug inner tube and said top end of said bottom plug inner tube being sealingly fitted together;

first shearable means connected between said inner tubes for retaining said inner tubes sealingly fitted together until a predetermined differential fluid pressure is exerted on said bottom plug inner tube which causes said shearable means to shear and said inner tubes to separate;

a coupling sealingly connected to said string of drill pipe or said circulation tool;

said top end of said top plug inner tube and the bottom end of said coupling being sealingly fitted together; and shearable means connected between said inner tube and said coupling for retaining said inner tube and coupling sealingly fitted together until a predetermined differential fluid pressure is exerted on said inner tube which causes said shearable means to shear and said inner tube and coupling to separate.

10. The assembly of claim 9 wherein said first and second shearable means each comprise one or more shear pins.

11. The assembly of claim 10 wherein said top plug inner tube includes an interior activating ball annular seat connected thereto.

12. The assembly of claim 11 wherein said activating ball annular seat connected to said top plug inner tube is larger than said activating ball annular seat disposed in said bottom plug inner tube whereby an activating ball adapted to seat on said annular seat disposed in said bottom plug inner tube passes through said annular seat connected to said top plug inner tube.

13. The assembly of claim 12 wherein said top and bottom annular cementing plugs each comprise:

a solid hollow insert; and an elastomeric jacket disposed around said insert, said jacket having a plurality of wipers thereon for sealingly engaging an inner surface of said pipe.

14. The assembly of claim 13 wherein said pipe is a string of casing or liner sections.

15. A method of cementing a pipe in a well bore by way of a string of drill pipe or a circulation tool disposed within the top of said pipe, said pipe including a float shoe or the like connected at the bottom thereof comprising the steps of:

(a) connecting a cementing plug assembly to said string of drill pipe or circulation tool, said assembly comprising a bottom annular cementing plug having a longitudinal internal opening extending therethrough, a bottom plug inner tube attached within said bottom plug internal opening, said inner tube including an interior activating ball annular seat at the lower end thereof, a lateral port disposed in the lower end portion of said inner tube above said activating ball annular seat, and said lower end portion of said inner tube being of a shape which provides a flow space exiting said bottom plug between the interior of said bottom plug internal opening and the exterior of said lower end portion of said inner tube;

a rupturable member which ruptures at a predetermined differential fluid pressure sealingly disposed over said lateral port in said bottom plug inner tube, a top annular cementing plug having a longitudinal internal opening extending therethrough, an elongated top plug inner tube snugly disposed through said top plug internal opening whereby said top plug is free to slide on said inner tube when a differential fluid pressure is exerted thereon, the bottom end of said top plug inner tube being sealingly attached to the top end of said bottom plug inner tube by a first differential fluid pressure activated releasable connecting means, the top end of said top plug inner tube being sealingly attached to said string of drill pipe or said circulation tool by a second differential fluid pressure activated releasable connecting means, said connecting means including an interior activating ball annular seat connected to said top plug inner tube which is larger than said activating ball annular seat disposed in said bottom plug inner tube, the differential fluid pressure required to activate said first differential fluid pressure activated releasable connecting means being a predetermined pressure, the differential fluid pressure required to rupture said rupturable member being a predetermined pressure higher than that required to activate said first releasable connecting means and the differential fluid pressure required to activate said second differential fluid pressure activated releasable connecting means being a predetermined pressure higher than that required to rupture said rupturable member;

(b) dropping a first activating ball into said cementing plug assembly having a size whereby said activating ball seats on said annular seat disposed in the lower end of said bottom plug inner tube thereby closing said bottom plug inner tube;

(c) pumping a cement slurry into said cementing plug assembly whereby the differential fluid pressure exerted on said closed bottom plug inner tube equals or exceeds the predetermined pressure required to activate said first releasable connecting means thereby releasing said bottom plug from said cementing plug assembly;

(d) continuing the pumping of said cement slurry until said bottom plug lands on said float shoe;

(e) continuing the pumping of said cement slurry until said differential fluid pressure exerted on said rupturable member equals the predetermined pressure required to rupture said rupturable member thereby rupturing said rupturable member and allowing said cement slurry to flow through said bottom plug inner tube into the annulus between the outside of said pipe and said well bore by way of said float shoe;

(f) dropping a second activating ball into said cementing plug assembly having a size whereby said activating ball seats on said annular seat connected to said top plug inner tube thereby closing said top plug inner tube;

(g) pumping a displacement fluid behind said top plug until the differential fluid pressure exerted on said second releasable connecting means equals or exceeds the predetermined pressure required to activate said second releasable connecting means thereby releasing said top plug from said cementing plug assembly;

(h) continuing the pumping of said displacement fluid into said pipe behind said top plug until said top plug lands on said bottom plug and said cement slurry has been displaced into said annulus; and (i) allowing said cement slurry to set in said annulus.

16. The method of claim 15 wherein said first releasable connecting means comprises:

said bottom end of said top plug inner tube and said top end of said bottom plug inner tube being sealingly fitted together; and shearable means connected between said inner tubes for retaining said inner tubes sealingly fitted together until a predetermined differential fluid pressure is exerted on said bottom plug inner tube which causes said shearable means to shear and said inner tubes to separate.

17. The method of claim 16 wherein said second releasable connecting means comprises:

a coupling sealingly connected to said string of drill pipe or said circulation tool;

said top end of said top plug inner tube and the bottom end of said coupling being sealingly fitted together; and shearable means connected between said inner tube and said coupling for retaining said inner tube and coupling sealingly fitted together until a predetermined differential fluid pressure is exerted on said inner tube which causes said shearable means to shear and said inner tube and coupling to separate.

18. The method of claim 16 or 17 wherein said shearable means comprises one or more shear pins.

19. The method of claim 18 wherein said top and bottom annular cementing plugs each comprise:

a solid hollow insert; and an elastomeric jacket disposed around said insert, said jacket having a plurality of wipers thereon for sealingly engaging an inner surface of said pipe.

20. The method of claim 19 wherein said pipe is a string of casing or liner sections.

21. The method of claim 15 which further comprises ensuring the sealing of said top plug on said bottom plug by continuing the pumping of said displacement fluid thereby exerting a differential pressure on said top plug until said top plug is moved downwardly on said top plug inner tube causing said inner tube to be realigned and to provide a fluid tight seal between said top plug and said bottom plug.

* * * * *